US007384512B2

(12) United States Patent
Weigant et al.

(10) Patent No.: US 7,384,512 B2
(45) Date of Patent: Jun. 10, 2008

(54) DEVICE FOR STABILIZING A PAPER WEB

(75) Inventors: Harald Weigant, Graz (AT); Gernot Zeletinger, Eisbach Rein (AT); Kurt Mitterböck, Graz (AT); Erwin Walcher, Deutsch-Kaltenbrunn (AT)

(73) Assignee: Andritz AG, Graz (AT)

( * ) Notice: Subject to any disclaimer, the term of this patent is extended or adjusted under 35 U.S.C. 154(b) by 422 days.

(21) Appl. No.: 11/026,828

(22) Filed: Dec. 30, 2004

(65) Prior Publication Data

US 2005/0161185 A1 Jul. 28, 2005

(30) Foreign Application Priority Data

Dec. 30, 2003 (AT) ..... A 2098/2003

(51) Int. Cl.
*D21G 3/04* (2006.01)

(52) U.S. Cl. ..... 162/281; 162/272

(58) Field of Classification Search ..... 162/193, 162/194, 255, 280–282, 306, 375; 226/93–96, 226/97.1, 97.3, 97.4; 34/117, 120, 659, 660; 15/256.51, 256.52, 256.53

See application file for complete search history.

(56) References Cited

U.S. PATENT DOCUMENTS

| | | | | | |
|---|---|---|---|---|---|
| 3,355,349 | A * | 11/1967 | Devlin | ..... | 162/286 |
| 3,756,912 | A * | 9/1973 | Rooney | ..... | 162/255 |
| 4,014,487 | A * | 3/1977 | Reba et al. | ..... | 226/5 |
| 4,179,330 | A * | 12/1979 | Page | ..... | 162/113 |
| 4,692,215 | A * | 9/1987 | Kerttula | ..... | 162/289 |
| 4,923,567 | A * | 5/1990 | Liedes et al. | ..... | 162/193 |
| 6,387,220 | B1 * | 5/2002 | Mohrsen et al. | ..... | 162/363 |
| 2002/0060036 | A1 * | 5/2002 | Linden | ..... | 162/283 |
| 2003/0183353 | A1 * | 10/2003 | Helgesson et al. | ..... | 162/191 |

* cited by examiner

*Primary Examiner*—Eric Hug
(74) *Attorney, Agent, or Firm*—Alix, Yale & Ristas, LLP

(57) ABSTRACT

The invention relates to a device for stabilizing a paper web, particularly a tissue web, with at least one (web) stabilizer (3, 7) after a drying cylinder (1), where the stabilizer (3) is located directly at the cylinder (1) under the paper web (2). It is mainly characterized by the angle of incidence α of the stabilizer (3) at the drying cylinder (1) being adjustable.

15 Claims, 2 Drawing Sheets

DEVICE FOR STABILIZING A PAPER WEB

BACKGROUND OF THE INVENTION

The invention relates to a device for stabilizing a paper web, particularly a tissue web, with at least one web stabilizer after the drying cylinder, where the stabilizer is located directly at the cylinder under the paper web.

A system for stabilizing a paper web, particularly a tissue web, is known from EP 1101863. Here, there are a number of stabilizers mounted after a tissue dryer. At the same time, the dust is removed from the upper side of the paper web. Before dust removal, a stabilizer is provided for the paper/tissue web which also takes away any additional air carried along with the web. Particularly in the production of high-grade tissue (soft tissue on conventional tissue machines and on TAD paper machines), the preferred doctor blades have a bevelled edge (ground to 5-40°) and web adhesion to the drying cylinder is kept relatively low, or it is virtually impossible to set a high level of adhesion by the paper web anyway. Thus, the web tends to move downwards and is only stabilized by the web tension that draws the paper web against the top stabilizer. As a result, there is a need to set the level of adhesion to the Yankee cylinder and/or a low degree of creping, which in turn has a negative effect on the strength and/or elongation of the paper.

SUMMARY OF THE INVENTION

The aim of the invention, therefore, is to guarantee the stability of a high-grade paper web, particularly a tissue web, immediately after it leaves the doctor blade and thus, to create a means of enhancing the paper quality and/or increasing the production speed.

According to the invention, this is achieved by using an adjustable angle of incidence for the stabilizer at the drying cylinder. In this way, a constant take-off angle is obtained for the paper web, which in turn secures good web guidance, while also preventing any web flutter.

A favourable embodiment of the invention is characterised by the angle of incidence of the stabilizer being adjustable independently of the angle of incidence of the doctor. As a result, the creping effect (creping angle) can be set independently of optimum web guidance by the stabilizer.

An advantageous further development of the invention is characterised by the stabilizer having openings for blowing out air or for extracting air from the web. Due to the action of blowing out or extracting air, the web is held onto the surface of the stabilizer by suction, thus further improving stability of web guidance.

If the stabilizer can be pivoted, particularly downwards, this will provide trouble-free operations in web-break mode and simplify re-threading of the web.

A preferred further development of the invention is characterised by the stabiliser being located at the doctor blade holder or doctor beam. The invention can be used particularly effectively with a Yankee drying cylinder.

An advantageous further development of the invention is characterised by the stabilizer being set at a distance of 0 to 500 mm away from the drying cylinder, preferably between 0 and 200 mm, e.g. approximately 50 mm.

BRIEF DESCRIPTION OF THE DRAWINGS

The invention will now be described using the examples in the drawings, where.

DESCRIPTION OF THE PREFERRED EMBODIMENTS

Figure 1:
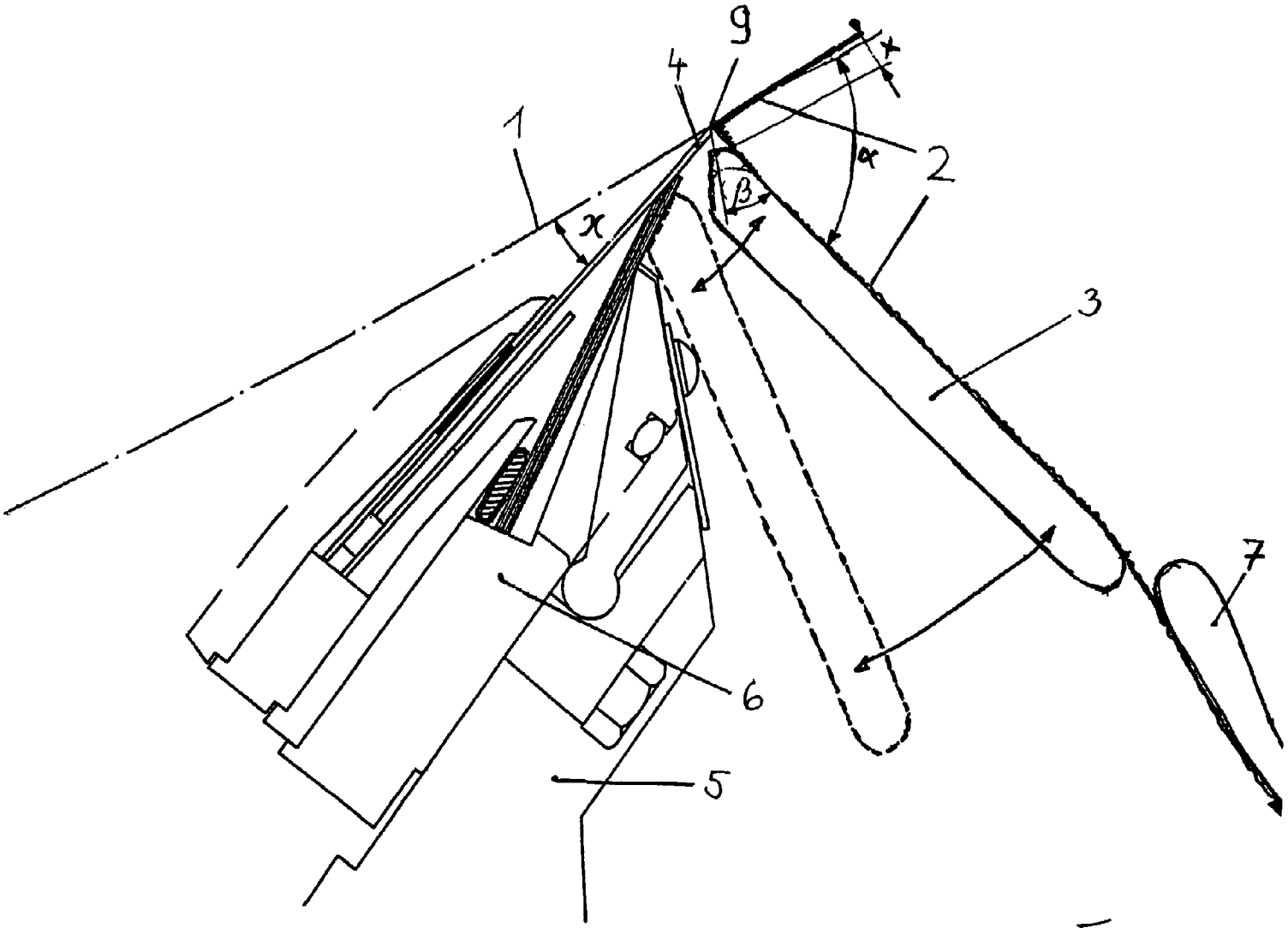
FIG. 1 shows one variant of the invention.

A large percentage of all tissue grades are produced with a Yankee cylinder 1 in the final drying stage. When it leaves this Yankee cylinder 1, the dried paper web 2 is picked up by a doctor blade 4 held in a doctor blade holder 6, which is supported by a doctor beam 5. From the pick-up point 9 at the Yankee cylinder 1, the web 2 runs over stabilizing elements 7, in certain cases over one or more calender rolls to a pope reel (not shown), which winds the web onto a reel there at a defined speed. The paper quality is influenced substantially at the take-off point 9. In order to be able to set the quality parameters, such as strength, elongation, softness and volume, to an optimum level, it is often necessary to keep adhesion of the paper web to the Yankee cylinder 1 low. Also, the speed at which the paper web is released towards the calender and pope reel is usually set very low. Similarly, the creping doctor 4 is run with a relatively large bevel angle $\beta$. All of these settings, however, lead to difficulties with the web stability and thus, to operating problems on the machine, compromises in quality, and speed limitations.

The invention is intended to reduce these disadvantages by transferring and guiding the paper web 2 directly at the take-off point 9 of the Yankee cylinder 1 using a stabilizing element 3, which is secured to a doctor holder 6 or a doctor beam 5, as shown in FIG. 1. The stabilizing element has a substantially flat, elongated upper surface under the web adjacent the take off point, for receiving the web as the web is removed by the doctor blade. In this context, "substantially flat" includes a slight curvature. The mounting can either be fixed or, preferably, pivoted. The downward pivoted position of the stabilizer 3 is marked with a broken line. In this position, the paper web can be threaded in again very easily following a web break. The stabilizer can also be secured to the frame of the paper machine. The angle of incidence a of the stabilizer can be adjusted here and is preferably between 80 and 100°. The angle of incidence (creping angle) $\chi$ of the doctor 4 can be adjusted independently of the angle of incidence $\alpha$ of the stabilizer, thus ensuring that both creping effect and web guidance can be adjusted individually to their optimum setting. The angle of incidence (creping angle) $\chi$ of the doctor 4 is usually approximately 10 to 35°. By separating the angle of incidence of the doctor and of the stabilizer, the paper web cannot run over the surface of the doctor and cause problems there.

Figure 2:
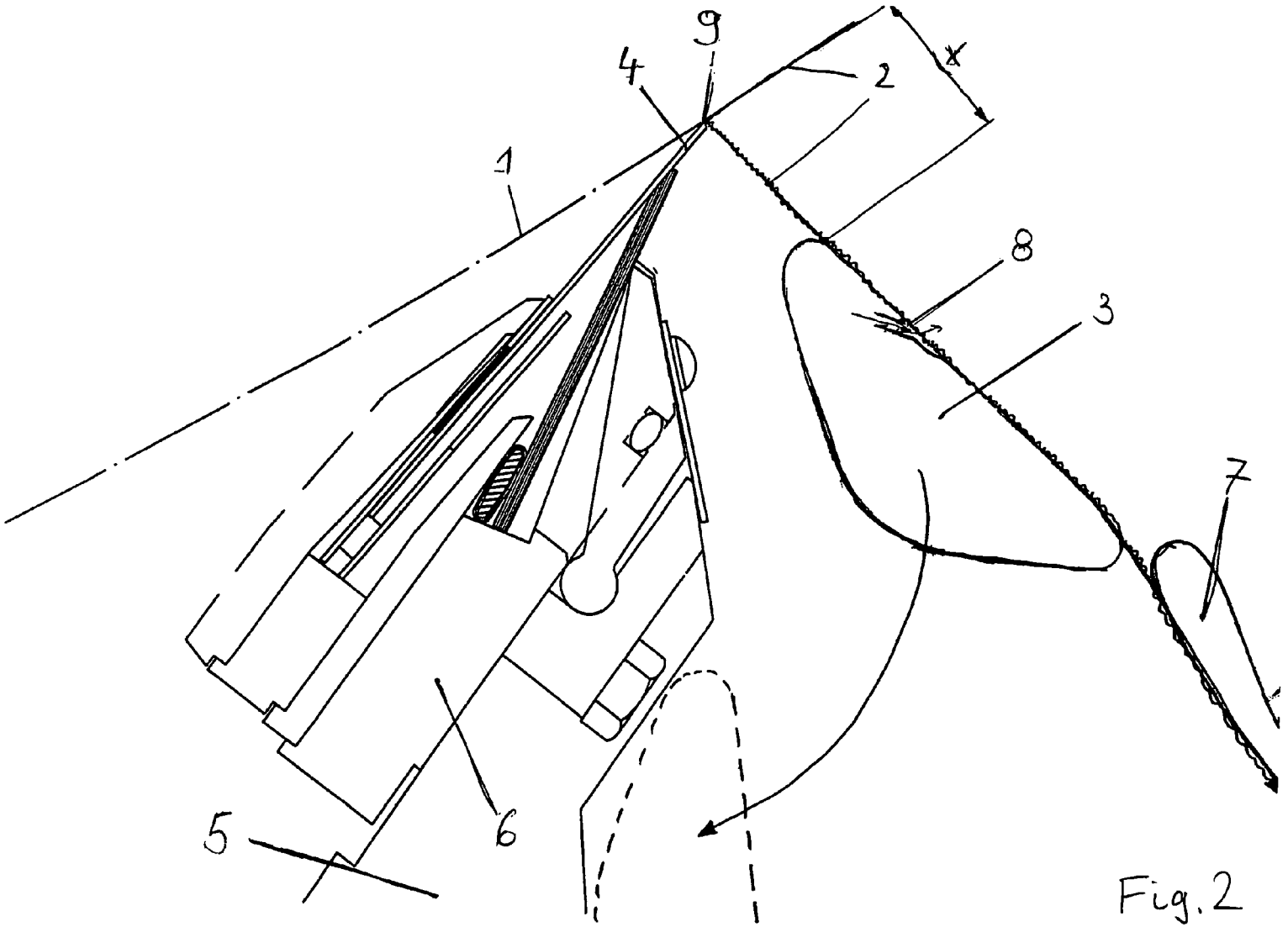
FIG. 2 shows a further variant of the invention.

A particularly advantageous embodiment is shown in FIG. 2, where the stabilizing element 3 has at least one opening 8 for blowing out compressed air or is supported from below and stabilized by an air suction opening 8, which is connected to a suction unit. Here, too, a broken line is entered to show the position to which the stabilizer 3 can be pivoted downwards. In order to guarantee optimum take-off angle $\alpha$ and optimum take-off stability, the spacing x between the stabilizing element 3 and the surface of the drying cylinder 1 must be kept as small as possible. The preferred spacing x is set between 0 and 200 mm, the most favourable setting being around 50 mm, with up to 500 mm in exceptional cases.

The invention claimed is:

1. Device for stabilizing a continuous paper web as the web is removed from a web drying cylinder at a take off point by a doctor blade having an adjustable blade angle of incidence (x) relative to a tangent to the cylinder at the take off point, comprising: a stabilizing element having a substantially flat, elongated upper surface situated under the web adjacent the take off point for receiving the web as the web is removed by the doctor blade, the doctor blade being mounted in a doctor blade holder supported by a doctor beam and the stabilizing element being secured to the doctor blade holder or doctor beam, wherein for each particular web the stabilizing element is adjustable to a constant angle of incidence ($\alpha$) relative to said tangent, whereby the particular web is continuously removed from the drying cylinder at a constant take-off angle.

2. Device according to claim 1, wherein the angle of incidence of the stabilizing element is adjustable independently of the blade angle of incidence.

3. Device according to claim 1, wherein the upper surface of the stabilizing element has openings for one of outward or inward air flow respectively toward or away from the web.

4. Device according to claim 1, wherein the stabilizing element is pivotable for adjusting the angle of incidence.

5. Device according to claim 1, wherein the drying cylinder is a Yankee cylinder.

6. Device according to claim 1, wherein the stabilizing element is situated a distance in the range of 0 to 500 mm from the drying cylinder.

7. Device according to claim 1, wherein the stabilizing element is situated a distance in the range of about 50-200 mm from the drying cylinder.

8. Device according to claim 2, wherein the upper surface of the stabilizing element has openings for one of outward or inward air flow respectively toward or away from the web.

9. Device according to claim 2, wherein the stabilizing element is pivotable for adjusting the angle of incidence.

10. Device according to claim 2, wherein the stabilizing element is situated a distance in the range of 0 to 500 mm from the drying cylinder.

11. Device according to claim 2, wherein the stabilizing element is situated a distance in the range of about 50-200 mm from the drying cylinder.

12. Device according to claim 8, wherein the stabilizing element is pivotable for adjusting the angle of incidence.

13. Device according to claim 8, wherein the stabilizing element is situated a distance in the range of 0 to 500 mm from the drying cylinder.

14. Device according to claim 8, wherein the stabilizing element is situated a distance in the range of about 50-200 mm from the drying cylinder.

15. Device according to claim 11, wherein the drying cylinder is a Yankee cylinder.

* * * * *